United States Patent [19]

Staerzl

[11] Patent Number: 4,643,147

[45] Date of Patent: Feb. 17, 1987

[54] ELECTRONIC FUEL INJECTION WITH FUEL OPTIMIZATION AND EXHAUST PRESSURE FEEDBACK

[75] Inventor: Richard E. Staerzl, Fond du Lac, Wis.

[73] Assignee: Brunswick Corporation, Skokie, Ill.

[21] Appl. No.: 589,413

[22] Filed: Mar. 14, 1984

[51] Int. Cl.[4] ..... F02M 39/00

[52] U.S. Cl. ..... 123/357; 123/489; 123/463

[58] Field of Search ..... 123/357, 489, 382, 383, 123/358, 359, 463

[56] References Cited

U.S. PATENT DOCUMENTS

| | | | |
|---|---|---|---|
| 2,374,844 | 5/1945 | Stokes | 123/463 |
| 2,397,984 | 4/1946 | Schorn | 123/463 |
| 2,422,808 | 6/1947 | Stokes | 123/463 |
| 2,438,662 | 3/1948 | Greenland | 123/463 |
| 2,440,567 | 4/1948 | Armstrong | 123/463 |
| 4,280,465 | 7/1981 | Staerzl | 123/494 |
| 4,388,905 | 6/1983 | Kurihara | 123/489 |

FOREIGN PATENT DOCUMENTS 2905640 8/1979 Fed. Rep. of Germany ..... 123/463

*Primary Examiner*—Carl Stuart Miller

*Attorney, Agent, or Firm*—Hopgood, Calimafde, Kalil, Blaustein & Judlowe

[57] ABSTRACT

An electronically controlled fuel-injection system for an internal combustion engine, wherein fuel injection control pulses drive associated fuel injectors for delivering fuel to the internal combustion engine. A fuel pump delivers fuel from an associated fuel tank to the fuel injectors and a pressure regulator associated with the fuel tank maintains a pressure differential across the fuel injectors. Exhaust back pressure from the internal combustion engine is applied to the pressure regulator, such that the pressure differential across the fuel injectors varies in response to pressure changes in exhaust back pressure. A linear relationship between exhaust back pressure and the pressure differential across the fuel injectors provides an inexpensive and accurate electronic fuel injection control system.

5 Claims, 3 Drawing Figures

ELECTRONIC FUEL INJECTION WITH FUEL OPTIMIZATION AND EXHAUST PRESSURE FEEDBACK

BACKGROUND OF THE INVENTION

This invention relates to an exhaust pressure feedback system used in conjunction with an electronic fuel injection control circuit for an internal combustion engine of the type described in U.S. Pat. No. 4,280,465, issued July 28, 1981 and assigned to the same assignee as the instant invention. Reference is made to said United States Patent for greater descriptive detail of a control circuit for a fuel injected engine to which the present invention is illustratively applicable.

In fuel injection control circuits of the character indicated, certain engine parameters are monitored and utilized to control the fuel injectors supplying fuel to each cylinder of the internal combustion engine. The engine parameters being monitored included manifold absolute pressure, manifold temperature, throttle angle, and engine speed. The fuel injectors are in turn supplied by a fuel pump connected to an associated fuel tank with a pressure regulator associated with the fuel tank being used to maintain a constant pressure differential across the fuel injectors to insure even fuel flow.

Although fuel injection control circuits of the type described are widely used and have numerous advantages, such systems are relatively complex and expensive. In particular, the necessity to monitor manifold absolute pressure and utilize this parameter to control the fuel injectors, adds substantial cost to such a fuel injection control circuit. In particular, it is estimated that the transducer necessary to monitor absolute pressure along with its associated circuitry accounts for nearly fifty percent of the cost of a fuel injection control circuit of the type described.

It is, therefore, an object of the instant invention to provide a fuel injection control circuit less complex and less expensive than those described in the prior art.

It is a further object of the instant invention to provide an inexpensive fuel injection control circuit by eliminating the necessity to monitor manifold absolute pressure as a parameter for controlling the fuel injectors.

It is a general object of the instant invention to achieve the above objects with generally uncomplicated circuitry adaptable to the fuel mixture requirements of a variety of sizes and styles of different fuel injected internal combustion engines.

SUMMARY OF THE INVENTION

In accordance with the instant invention there is provided an electronically controlled fuel injection control system for internal combustion engines. The fuel injection system includes apparatus to provide fuel injection control pulses to associated fuel injectors, a fuel pump delivering fuel from a tank to the fuel injectors, and a pressure regulator associated with the fuel tank to maintain a pressure differential across the fuel injectors.

In accordance with a first feature of the instant invention, there is provided apparatus for applying exhaust back pressure from the internal combustion engine to the pressure regulator, whereby pressure across the fuel injectors will vary in response to pressure changes in the exhaust back pressure.

It is a further feature of the instant invention that there is a linear relationship between changes in exhaust back pressure and changes in pressure differential across the fuel injectors.

It is a still further feature of the invention that utilizing exhaust back pressure to regulate fuel pressure provides an electronically controlled fuel injection system which does not require monitoring of manifold absolute pressure for accurate and reliable operation.

The foregoing and other objects and features will be more ully understood from the following description of an illustrative embodiment thereof, taken in conjunction with the accompanying drawings.

DETAILED DESCRIPTION

Figure 1:
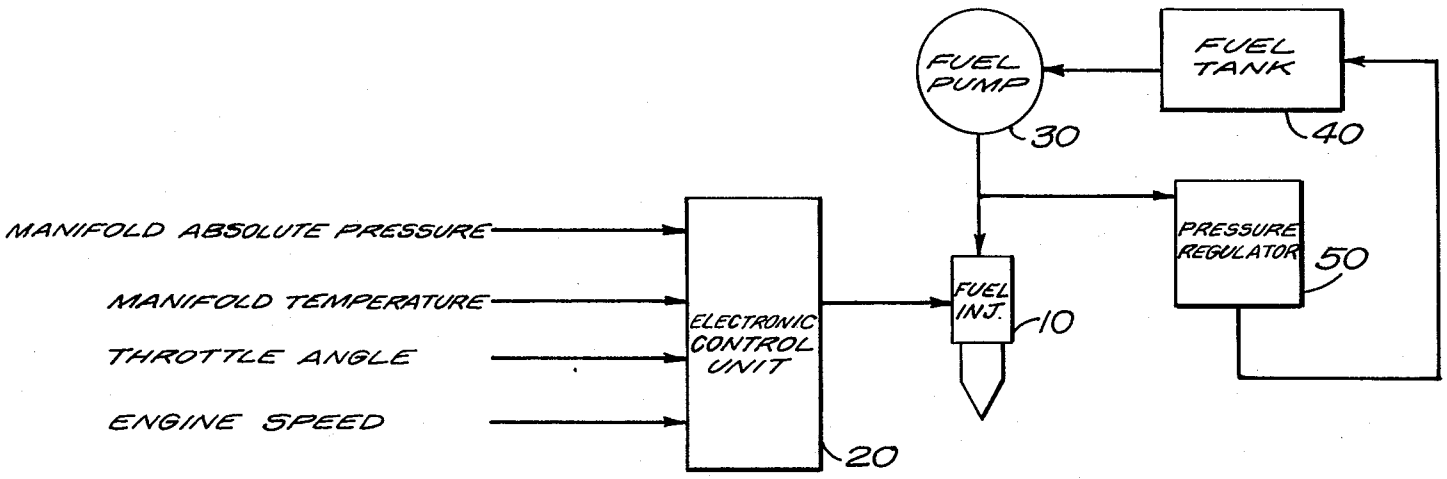
FIG. 1 illustrates an electronically controlled fuel injection system of the type utilized in the prior art.

U.S. Pat. No. 4,280,465, the teachings of which are incorporated herein by reference, describes a fuel injection control circuit in which one or more square wave pulse generators drive solenoid operated fuel injectors unique to each cylinder, there being a single control system whereby the pulse generators are modulated as necessary to accomodate throttle demands in the context of engine speed and other factors. FIG. 1 herein is a simplified block diagram of such a fuel injection control circuit.

The control system of FIG. 1 described more fully in U.S. Pat. No. 4,280,465, is generally utilized with a two cycle, six cylinder, 60-degree V-engine, wherein injectors for cylinders #2, #3, and #4 are operated simultaneously, under the control of the pulse output of a first square wave generator, (not shown), while the remaining injectors (for cylinders #5, #6 and #1) are operated simultaneously under the control pulse output of a second square wave generator (not shown). The base, or crankshaft angle for which the square wave output pulses from the first square wave generator is timed, is determined by ignition firing at cylinder #1, while the timing for pulses generated by the second square wave pulse generator is similarly based upon ignition firing at cylinder #4. The actual time duration of all such generated pulses varies in response to the amplitude of a control signal supplied to both square wave pulse generators. Fuel injectors 10, shown in FIG. 1 is a simplified illustration of the fuel injectors for such a control system along with the associated circuitry necessary for operating the fuel injectors.

The fuel injectors are controlled by electronic control circuit 20, which operates on various input parameters in the form of analog voltages. More specifically, a first sensor detects and monitors manifold absolute pressure, a throttle switch is utilized to detect throttle angle and third and fourth sensors monitor engine speed and manifold temperature, all of these parameters being used to generate control signals for the fuel injectors. Also shown in FIG. 1 is the manner in which fuel is supplied to the fuel injectors, namely through use of fuel pump 30 and associated fuel tank 40. Also included is pressure regulator 50 which functions to maintain a constant pressure differential across the fuel injectors to provide an even fuel flow rate.

The instant invention is concerned with providing an electronically controlled fuel injection system which will function as accurately and as reliably as the type of system shown in FIG. 1, but at substantially reduced cost. More particularly, it has been determined that approximately 50% of the cost for a fuel injection control system of the type shown in FIG. 1 is directly related to the manifold absolute pressure transducer and its associated circuitry. Accordingly, if a system could be found to accurately operate without requiring manifold absolute pressure as an input parameter, such a system would be advantageously less expensive than the type of system shown in FIG. 1. The instant invention is concerned with such an electronically controlled fuel injection system which provides accuracy and reliability for controlling the fuel flow to an associated internal combustion engine, but does so without the necessity for monitoring manifold absolute pressure.

Figure 2:
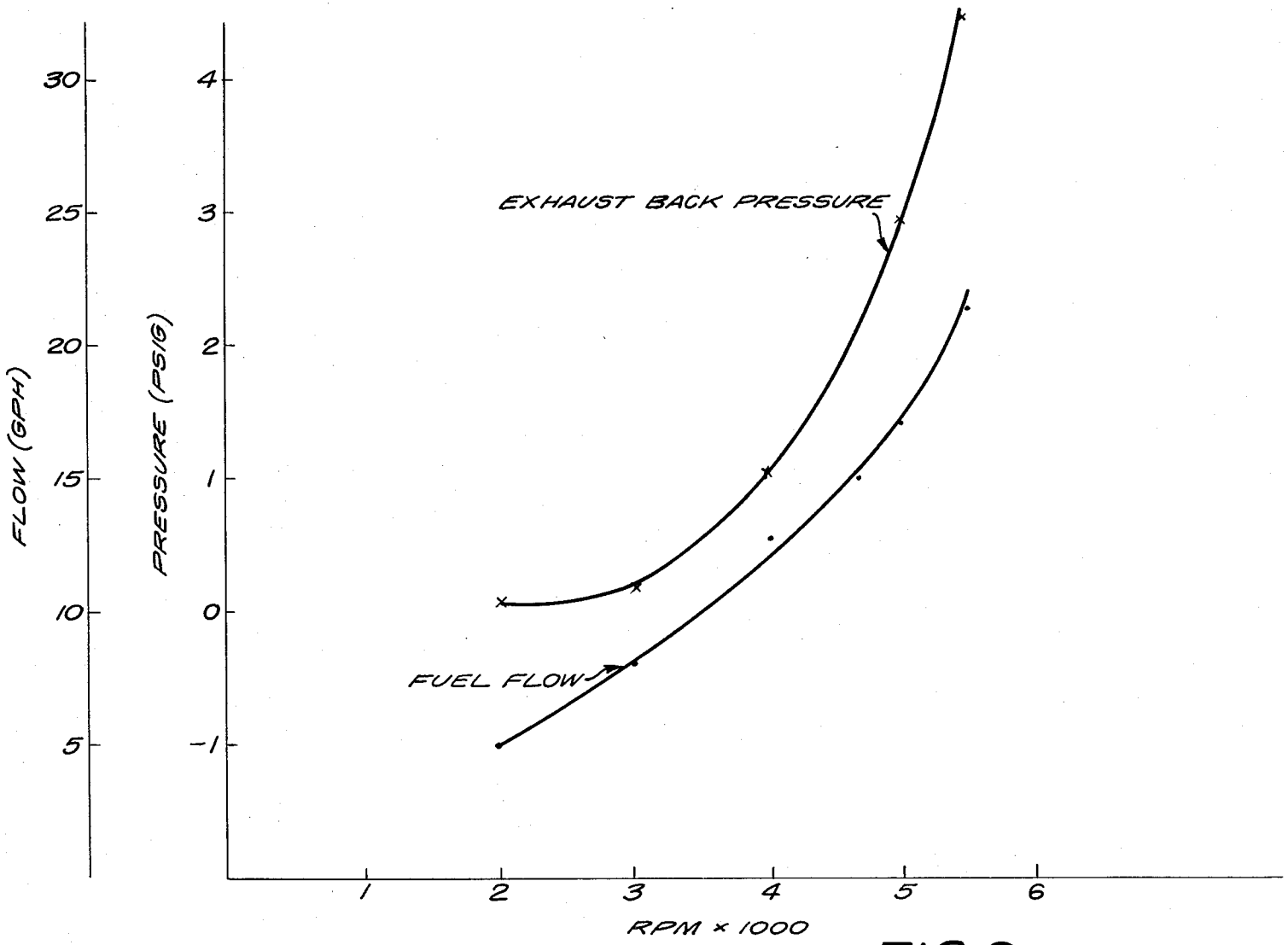

Referring now to FIG. 2, there is illustrated a graph showing exhaust pressure and fuel flow in relation to engine speed. This graph is generally representative of the data associated with a typical boat load curve as the engines associated with the fuel injection system described herein are particulary suitable for marine use. It is known that top engine speed for engines of the type herein discussed, is approximately 5,600 RPM close to sea level, and approximately 4,000 RPM at an altitude of 3,500 feet. From the graph, therefore, it can be seen that back pressure decreases as altitude increases. If engine back pressure were to modulate the fuel pressure, then fuel pressure would also fall with an increase in altitude. Such a correction would be in the proper direction as shown by the fuel flow curve in FIG. 2.

Part throttle load correction is also demonstrated by the graph of FIG. 2 since engine speed can be replaced by boat load. For example, to maintain a given speed when a boat is loaded, the engine power must be increased and with this fuel flow and back pressure also increases.

Figure 3:
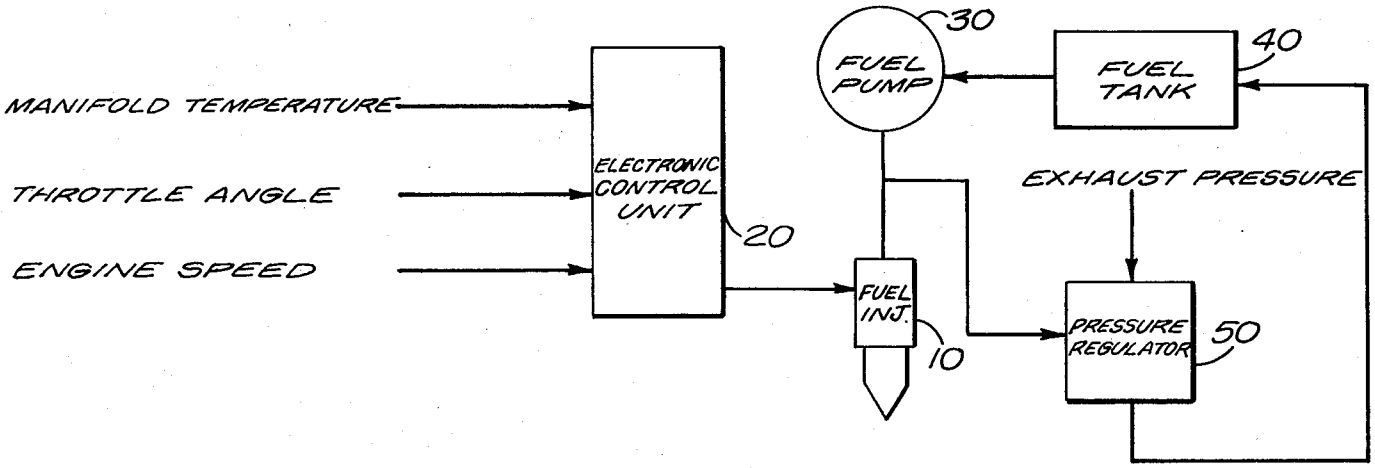
FIG. 2 illustrates a graph of exhaust back pressure and fuel flow versus engine speed in accordance with the instant invention and FIG. 3 illustrates a block diagram of an exhaust pressure feedback system in accordance with the invention.

Referring now to FIG. 3, there is shown a block diagram of the electronic fuel injection system of the instant invention. More particularly, electronic control unit 20 now monitors only three parameters, manifold temperature, throttle angle and engine speed and does not monitor manifold absolute pressure, thus eliminating the most expensive portion of the circuit shown in FIG. 1, as described above. The electronic control circuit as before drives fuel injectors 10, which are in turn supplied by fuel pump 30 connected to associated fuel tank 40. Pressure regulator 50 also functions in the same manner as is the circuit in FIG. 1, but in this instance, the pressure regulator is modulated by the exhaust back pressure and is not modulated by only atmospheric pressure as is the embodiment of FIG. 1. Pressure regulator 50 is commercially available, supplied for examply by ROBERT BOSCH GMBH of West Germany and thus further description of its operation will not be provided. With a feedback arrangement as shown, the back pressure modulates the pressure regulator such that a linear relationship is established between exhaust back pressure and fuel pressure, thereby providing an electronic fuel injection control circuit with accuracy and reliability, but eliminating the expense of the manifold absolute pressure transducer and its associated circuitry.

Although a specific embodiment of this invention has been shown and described, it will be understood that various modifications may be made without departing from the spirit of this invention.

I claim:

1. In a multi-cylinder internal combustion engine having an electronically controlled fuel-injection system wherein a pulse generator provides, to associated fuel injectors, fuel-injection control pulses of time duration proportioned to engine speed and to other factors including desired throttle setting and manifold temperature, and wherein a fuel pump delivers fuel at a predetermined pressure from a tank to a manifold serving the fuel injectors for the respective cylinders, and a pressure regulator associated with said fuel tank and with said fuel pump maintains substantially constant said predetermined pressure and thereby maintains a controlled pressure differential across said fuel injectors, the improvement comprising a pulse generator control unit having no manifold absolute pressure detector coupled thereto, means for monitoring the exhaust back pressure from said internal combustion engine and means responsive to said monitoring means and coupled to said pressure regulator for effecting control of said pressure differential as a function of changes in said exhaust back pressure.

2. In a multi-cylinder internal combustion engine in accordance with claim 1, wherein there is a linear relationship between changes in said exhaust back pressure and changes in said fuel pressure differential.

3. In a multi-cylinder internal combustion engine in accordance with claim 2, wherein said monitoring and changing means includes said pressure regulator.

4. An electronically controlled fuel-injection system for an internal combustion engine comprising, means operative without a manifold absolute pressure detector coupled thereto for providing fuel-injection control pulses to associated fuel injectors, a fuel pump delivering fuel from a tank to said fuel injectors at a predetermined pressure, a pressure regulator associated with said fuel tank and said fuel pump to maintain substantially constant said predetermined pressure and thereby maintain a predetermined constant pressure differential across said fuel injectors and means for applying exhaust back pressure from said internal combustion engine to said pressure regulator whereby said constant pressure differential across said fuel injectors is predetermined as a function of pressure changes in said exhaust back pressure.

5. An electronically controlled fuel-injection system in accordance with claim 4, wherein there is a linear relationship between changes in said exhaust back pressure and changes in said pressure differential across said fuel injectors.

* * * * *